US006102403A

United States Patent [19]

Kaufman

[11] Patent Number: 6,102,403

[45] Date of Patent: Aug. 15, 2000

[54] METHOD FOR PLAYING HIGH-LOW CARD GAME

[75] Inventor: Alfonse S. Kaufman, Long Beach, N.Y.

[73] Assignee: A&L Associates Creative Games, LLC, Westport, Conn.

[21] Appl. No.: 09/233,034

[22] Filed: Jan. 20, 1999

[51] Int. Cl.[7] ..... A63F 1/00

[52] U.S. Cl. ..... 273/292; 463/11

[58] Field of Search ..... 273/292, 274, 273/309; 463/11, 12, 13

[56] References Cited

U.S. PATENT DOCUMENTS

| | | | |
|---|---|---|---|
| 1,982,534 | 11/1934 | Parker | 273/303 |
| 4,651,997 | 3/1987 | Wood | 273/274 |
| 5,294,128 | 3/1994 | Marquez | 273/292 |
| 5,324,041 | 6/1994 | Boylan et al. | 273/292 |
| 5,476,265 | 12/1995 | Miller et al. | 273/292 |
| 5,628,514 | 5/1997 | Nguyen et al. | 273/292 |
| 5,692,755 | 12/1997 | Gutierrez | 273/292 |
| 5,697,614 | 12/1997 | Potter et al. | 273/292 |
| 5,720,484 | 2/1998 | Hsu | 273/292 |
| 5,810,354 | 9/1998 | Banyai | 273/292 |

OTHER PUBLICATIONS

"Low–Max" brochure, 1998.
"Magic 7" brochure, 1998.

*Primary Examiner*—Benjamin H. Layno

*Attorney, Agent, or Firm*—Fitzpatrick, Cella, Harper & Scinto

[57] ABSTRACT

A method of playing a card game includes the steps of providing a playing board with at least one player card position and corresponding high/low betting area for each player and at least one dealer card position for the dealer, and providing a deck of cards including at least one wild card. The steps include placing at least one high/low wager in a high/low betting area by each player, dealing one card to each player card position having a high/low wager in its corresponding high/low betting area, dealing at least one card to the dealer card position, and comparing a card in each player card position with a card in a corresponding dealer card position. If a player card is ranked higher than the of a corresponding dealer card, the player wins according to first predetermined odds if the player wagered high and loses if the player wagered low. If a player card is ranked lower than the corresponding dealer card, the player wins according to the first predetermined odds if the player wagered low and loses if the player wagered high. If a player card is a wild card and a corresponding dealer card is a wild card, the player wins according to at least second predetermined odds higher than the first predetermined odds. If a player card is a wild card, and a corresponding dealer card is not, the player's wager is used in another level of comparison.

34 Claims, 2 Drawing Sheets

METHOD FOR PLAYING HIGH-LOW CARD GAME

BACKGROUND OF THE INVENTION

1. Field of the Invention

The present invention generally relates to card games and, in particular, card games utilizing high-low wagering with standard or modified decks of playing cards.

2. Description of Related Art

Many card games that utilize high-low wagering are known. In these types of card games, the general goal is to wager whether a player's card will be higher or lower than a dealer's card. In a basic high-low card game, the payout odds and the betting options are generally limited.

U.S. Pat. No. 5,324,041 is a modified wagering game based on the traditional card game of "War." The players make ante bets and are dealt cards which are compared to the dealer's card. A player wins when the player's card is higher than the dealer's, but loses when it is of an equal or lesser value. Players can also make an optional tying bet, wherein if a player's and the dealer's cards are of an equal value, the player wins the tying bet, with the payoff being relatively high since the odds of winning such a bet are greater. A player who has made a tying bet can optionally make an additional wager after the tying bet is paid off, where additional cards are dealt to the dealer and the player and compared. The payoff for these additional bets is slightly better than that for the original bets. If "no-value" cards are inserted in the deck, bets can be made on whether these cards would be dealt. There are no additional payoffs when matched or unmatched wild cards are dealt in the original deal.

U.S. Pat. No. 5,692,755 relates to a casino card game in which the players play against a dealer, but only three cards are dealt face-up at one time. Players can make three wagers: whether the third dealt card is red or black, whether the third card is a high or low ranking card, or whether a card dealt in the third position will match either the card in the first position or the card in the second position. Players do not make high-low wagers comparing their cards to the dealer's cards, and although wild joker cards are used in this game, there is no second level of play when a joker is dealt.

U.S. Pat. No. 4,651,997 relates to a card game in which a player places a first wager and a dealer deals two cards face-up. If the cards are of equal rank the player wins an amount according to odds posted on the playing surface, but loses if the two cards are of consecutive rank. If the two cards are not the same or of consecutive ranks, the player can place a second wager as to whether a third dealt card is of a rank between the two first cards. If the first two cards dealt are of equal rank and that rank is a face card or an ace, the player automatically wins according to the posted odds and is dealt a third card which, if of equal rank to the first two cards, increases the player's winnings. The player's cards are not compared to the dealer's cards and no wild cards are used.

U.S. Pat. No. 5,628,514 relates to an Asian High-Low card game played with 15 conventional decks with the seven through king cards removed therefrom. Players play amongst themselves with one player serving as a banker. The object of the game is to make a hand totalling 12 or closest to 12 (if a high winning scheme is selected) or totalling 2 or closest to 2 (if a low winning scheme is selected). High-low wagers are not made in this game and there is no second level play for wild cards.

SUMMARY OF THE INVENTION

An object of the invention is to provide a card game based on high-low wagering using a modified deck of cards.

Another object of the present invention is to provide a fast-paced and exciting card game that will attract both novice and experienced players.

Another object of the present invention is to provide a card game that can be played at relatively low stakes, but can provide a relatively high payout.

Yet another object of the present invention is to provide an entertaining card game that provides a favorable advantage to the house.

In one aspect of the present invention, a method of playing a card game among a dealer and at least one player includes the steps of providing a playing board with at least one player card position and corresponding high/low betting area for each player and at least one dealer card position for the dealer and providing at least one composite deck of cards including at least one "wild" card. The method further includes the steps of placing at least one high/low wager in a high/low betting area by each player, dealing one card to each player card position having a high/low wager in its corresponding high/low betting area, dealing at least one card to the dealer card position, and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is a wild card, the player's wager is used in another level of comparison.

In another aspect of the present invention, a method of playing a card game among a dealer and at least one player also includes the steps of providing a playing board with at least one player card position and corresponding high/low betting area for each player and at least one dealer card position for the dealer and providing at least one composite deck of cards including at least two "wild" cards. The method further includes the steps of placing at least one high/low wager in a high/low betting area by each player, dealing one card to each player card position having a high/low wager in its corresponding high/low betting area, dealing at least one card to the dealer card position, and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is a wild card and a corresponding dealer card is a wild card, the player wins according to at least second predetermined odds higher than the first predetermined odds.

In yet another aspect of the present invention, a method of playing a card game among a dealer and at least one player includes the steps of providing a playing board with at least one player card position and corresponding high/low betting area for each player and at least one dealer card position for the dealer, providing at least one composite deck of cards including plural "wild" cards, at least two of which match, and placing at least one high/low wager in a high/low betting area by each player. The method further includes the steps of dealing one card to each player card position having a high/low wager in its corresponding high/low betting area, dealing at least one card to the dealer card position, and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is of rank equal to the rank of a corresponding dealer card, the player loses regardless of whether the player wagered high or low. If a player card is not a wild card and a corresponding dealer card is a wild card, the player loses regardless of whether the player wagered high or low. If a player card is a wild card and a corresponding dealer card is not a wild card, the player's wager is used in another level of comparison. In the other level of comparison, an additional card is dealt and if the additional card is a low card, the player wins according to second predetermined odds if the player originally wagered low, if the additional card is a high card, the player wins according to the second predetermined odds if the player originally wagered high, and if the additional card is a wild card, the player wins according to third predetermined odds, including lower and higher levels of odds. If the additional card is a wild card that does not match the player's wild card, the player wins according to the lower level of odds and if the additional card is a wild card that matches the player's wild card, the player wins according to the higher level of odds.

In yet another aspect of the present invention, a method of playing a card game among a dealer and at least one player includes the steps of providing a playing board with at least two players card positions and corresponding high/low betting areas for each player and at least two dealer card positions for the dealer, and providing at least one composite deck of cards including "wild" cards. The method further includes the steps of placing at least one high/low wager in a high/low betting area by each player, dealing one card to each player card position having a high/low wager in its corresponding high/low betting area, dealing at least one card to the dealer card position and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is of rank equal to the rank of a corresponding dealer card, the player loses regardless of whether the player wagered high or low. If a player card is not a wild card and a corresponding dealer card is a wild card, the player loses regardless of whether the player wagered high or low. If a player card is a wild card and a corresponding dealer card is a wild card, the player wins according to at least second predetermined odds higher than the first predetermined odds. If the player's wild card does not match the dealer's wild card, the player wins according to the second predetermined odds, if the player's wild card matches the dealer's wild card, the player wins at least according to third predetermined odds higher than the second predetermined odds, if matched wild cards are dealt in one player card position and one corresponding dealer card position, the player wins according to the third predetermined odds and if matched wild cards are dealt in at least two player card positions of one player and corresponding dealer card positions, the player wins according to a level of odds higher than the third predetermined odds or wins a predetermined jackpot.

In still another aspect of the present invention, an apparatus for playing a card game among at least one player includes means for displaying a playing board with at least one player card position and corresponding high/low betting area for each player and at least one dealer card position, and displaying cards from at least one composite deck of cards including at least one "wild" card. The apparatus further includes means for inputting at least one high/low wager in a high/low betting area by each player, and operation means for dealing one card to each player card position having a high/low wager in its corresponding high/low betting area, dealing at least one card to the dealer card position, and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is a wild card, the player's wager is used in another level of comparison.

In a still further another aspect of the present invention, an apparatus for playing a card game among at least one player includes means for displaying a playing board with at least one player card position and corresponding high/low betting area for each player and at least one dealer card position, and displaying cards from at least one composite deck of cards including at least two "wild" cards. The apparatus further includes means for inputting at least one high/low wager in a high/low betting area by each player and operating means for dealing one card to each player card position having a high/low wager in its corresponding high/low betting area, dealing at least one card to the dealer card position, and comparing a card in each player card position with a card in a corresponding dealer card position. If a player card is of a rank higher than the rank of a corresponding dealer card, the player wins according to first predetermined odds if the player wagered high and loses if the player wagered low. If a player card is of a lower rank than the rank of a corresponding dealer card, the player wins according to the first predetermined odds if the player wagered low and loses if the player wagered high. If a player card is a wild card and a corresponding dealer card is a wild card, the player wins according to at least second predetermined odds higher than the first predetermined odds.

In yet another aspect of the present invention, an apparatus for playing a card game among a dealer and at least one player includes a playing board with at least two player card positions and corresponding high/low betting areas for each player, the player card positions for receiving cards in an initial round, at least two dealer card positions for the dealer, and an area for cards dealt in an advanced round. The apparatus also includes at least one composite deck of cards including plural "wild" cards, at least two of which match.

These and other objects, aspects, features and advantages of the present invention will become apparent from the following detailed description of the preferred embodiments taken in conjunction with the accompanying drawings.

DETAILED DESCRIPTION OF THE PREFERRED EMBODIMENTS

A description of a preferred embodiment of the game playing method of the present invention will now be described with reference to FIG. 1.

Figure 1:
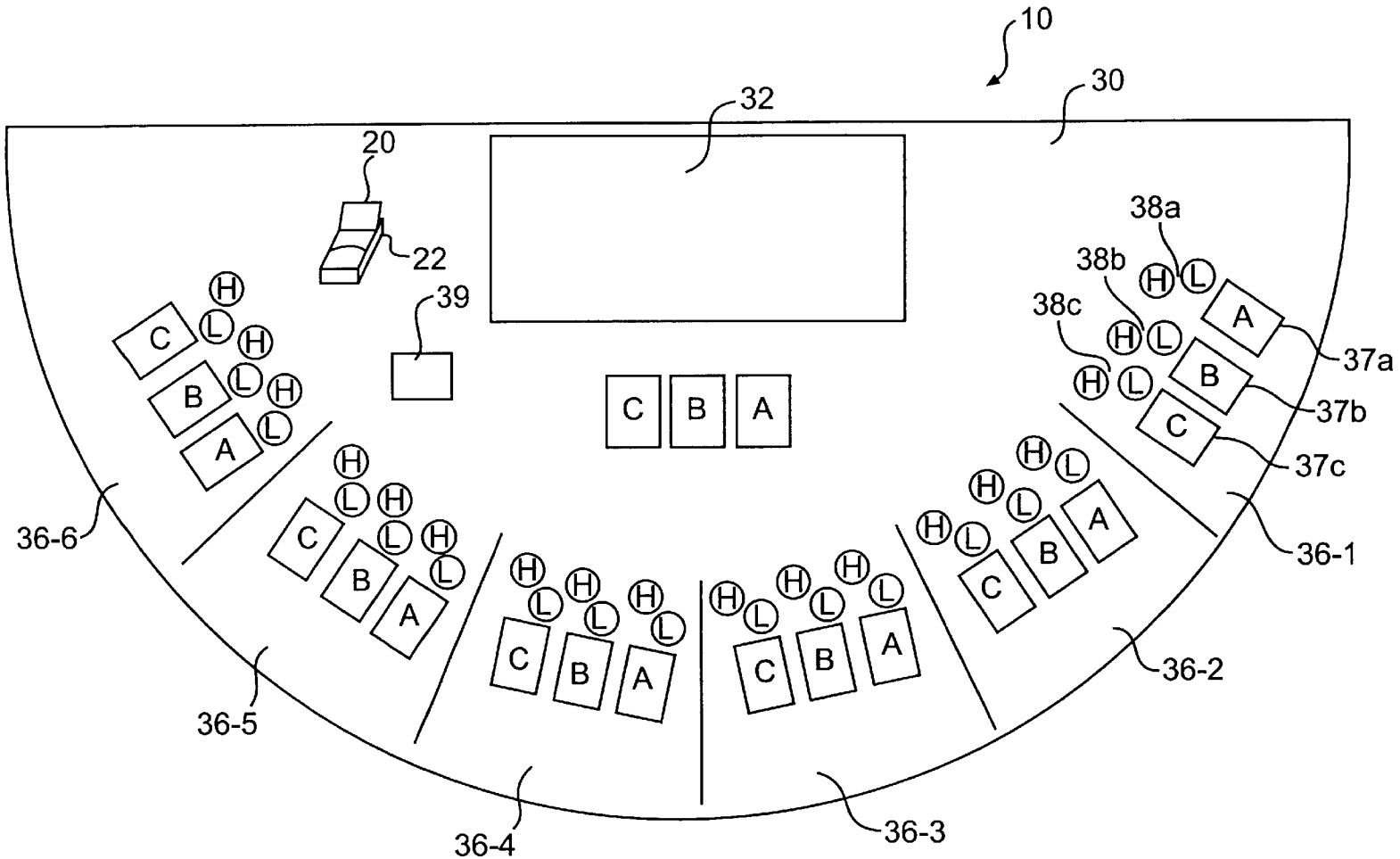
FIG. 1 shows a preferred layout of the card table used in connection with the card playing method of the present invention.

FIG. 1 shows the gaming apparatus 10 preferred for use with the game playing method. Gaming apparatus 10 includes a deck of cards 20 provided in a shoe 22, and a game table 30. Game table 30 is preferably of a semicircular shape similar to that used for casino blackjack. Typically, the dealer stands behind the flat side and one to seven players are situated around the rounded side.

Game table 30 includes a section 32 for storing dealer chips and a series of dealer card positions 34*a* to 34*c*. The three dealer card positions are distinguished from one another in any desired fashion. In the shown embodiment, each dealer card position is assigned a different letter, "A", "B" or "C". This is not limiting, however, and other distinguishing indicia such a numbers, symbols or colors can be used. Game table 30 further includes several player sections 36-1 to 36-6. Each player section includes a series of player card positions 37*a* to 37*c*, corresponding in number to the number of dealer playing card positions, with each player card position being associated with a high-low betting area 38*a* to 38*c*. Each high-low betting area may contain two circles with "H" or "L" printed therein.

Each player card position is distinguished similarly to the dealer card positions. In the shown embodiment, each player card position is also labelled "A", "B" or "C". Also disposed adjacent the dealer card positions and the dealing shoe is a "wild" box or area 39, the purpose of which will be described later.

Deck of cards 20 for use in the card playing method of the present invention will now be described. Preferably, a standard playing card deck is used, with several "wild" cards included. In a preferred embodiment, two standard playing card decks are used with the eights removed and being replaced with five pairs of wild cards. The wild cards do not have any value, but are provided with symbols, figures, characters or other indicia to designate them as wild cards. For example, each pair of wild cards can be designated with a different wild animal, such as a lion, a tiger, an elephant, a bull or a cougar. Thus, in the preferred embodiment the deck consists of 106 cards, ten of which are wild. Of course, any number of cards can be used and it is not required that the eights be removed. Furthermore, instead of adding wild cards to standard playing card decks, existing cards, such as aces or eights, can be designated as being wild. As one example, two standard playing card decks can be used with two of the four jokers being removed and the remaining two jokers as well as the eight eights being designated as wild.

In the preferred embodiment, three player card positions 37*a* –37*c* are provided for each player. This number is not intended to be limiting. The number of player card positions 34*a* –34*c* can range from one to four or more per player, and is equal to three in the preferred embodiment. The number of dealer card positions is equal to the number of player card positions for each player, that is, three for the shown embodiment.

To begin play, each player places one or more wagers, of either high or low, as desired, in the high-low betting areas 38*a* to 38*c* corresponding to each player card position. In the preferred embodiment, with three playing card positions per player, each player is not required to place three wagers for each round, but has the option of placing one to three wagers. As will be explained below, however, placing three wagers is required to participate in the optimum payout aspect of the game.

After the wagers have been placed, the dealer deals out one card from shoe 22 to each playing card position having a wager in a corresponding high-low betting area. For example, assume the player in section 36-1 has placed a single wager in one of high-low betting areas 38*a* –38*c*, the player in section 36-2 has placed two wagers, the player in section 36-3 has placed three wagers and the players in sections 36-4 to 36-6 have each placed one wager. Then, the player in section 36-1 will be dealt one card face-up in the player card position corresponding to the location of his or her single bet. The player in section 36-2 will be dealt two cards face-up in two of his or her player card positions, the player in section 36-3 three cards face-up in each of his or her three player card positions, and each of the players in sections 36-4 to 36-6 one card face-up in one respective player card position.

The dealer then deals one or more cards face-down in dealer card positions 36*a* to 36*c*. The number of dealer cards to be dealt is equal to the highest number of cards dealt to any one player. Therefore, in the foregoing example because the player at section 36-3 has been dealt three cards, then the dealer will also be dealt three cards.

Each dealer card is then overturned one at time and compared to corresponding player cards and payout is made depending on the high/low bets. Preferably the comparisons and payouts are made in a clockwise direction beginning with player section 36-1. The card dealt in dealer card position "A" is compared with the cards dealt in player positions "A", that in dealer position "B" to those in player positions "B", and that in dealer position "C" to those in player positions "C." Payout is decided as follows: if a player has placed a bet on "high" for position "A", then if his or her card is higher than the dealer's position "A" card, the player wins even money (1 to 1), but if his or her card is equal to or lower than the dealer's position "A" card, then the player loses the original bet. On the other hand, if the player has placed a bet on "low" in position "A", then if his or her card is lower than the dealer's position "A" card the player wins even money, but if his or her card is equal to or higher than the dealer's position "A" card, the player loses the original bet.

Payout is different when a wild card is dealt. In a case where a player's card is not wild whereas the corresponding dealer's card is wild, the player loses the bet. In a case where both the dealer and the player have a wild card in the same position, then the player is paid off at odds that are greater than 1 to 1 if the two wild cards do not match and at even greater odds if the two wild cards match. Moreover, if the player has placed wagers corresponding to more than one player card position and wild cards match in two or three card positions, then the pay out is even greater. As an example, the payout can be as follows:

| WILD CARD COMBINATIONS | PAYOUT |
|---|---|
| Unmatched Wild Cards in One or More Positions | 1.5 to 1 (per position) |

-continued

| WILD CARD COMBINATIONS | PAYOUT |
|---|---|
| Matched Wild Cards in One Position | 8 to 1 |
| Matched Wild Cards in Two Positions | 1000 to 1 (per player) |
| Matched Wild Cards in Three Positions | $100,000 (per player) |

If a player has two or more wild cards that match with corresponding dealer wild cards, that player is only paid out once according to the predetermined odds. That is, in the above example, if a player has matched wild cards in two positions, he or she is paid out 1000 to 1 for only one of the bets. Likewise, if the player has three matched wild cards, then he or she is given a single jackpot of $100,000. To avoid confusion, it may be preferable to require that players making more than one wager per deal place the same bet amount per player card position.

In a case where the player's card is wild and the corresponding dealer's card is not wild, then the game proceeds to an advanced high-low level with the player's original bet remaining in action. Preferably, the dealer does not begin the advanced level until all of the player's bets that do not advance to this level have been settled. In the advanced level, the dealer turns over the next card in shoe 22 and places it in wild box or area 39. In the preferred embodiment, twos through sevens count as low and nines through aces count as high. The player's original high-low bet determines whether the player wins. For example, if the player originally bet low and the card drawn by the dealer is a low card, then the player will be paid 2 to 1, for example, on the amount of the original bet. If the card drawn by the dealer is a high card, then it is a push (i.e., the player does not win any money but retains his original bet). If the card drawn by the dealer is a wild card that does not match the player's wild card, then the player is paid 3 to 1, for example, whereas if a wild card is drawn that matches the player's wild card, the player is paid 5 to 1, for example. In the advanced level, the dealer draws a new card for each player card position that has advanced to the advanced level. Of course, this is not limiting and in the advanced level one card can be dealt per player regardless of how many cards have advanced or one card can be drawn for the entire table regardless of how many players have cards that have advanced.

After this advanced level, the deck is preferably shuffled and the game starts over with a new round. This makes card counting virtually impossible.

It should be noted that the payout odds and the jackpot discussed above are only exemplary. Any suitable odds can be used depending on the desired house advantage. Also, the card playing method is not to be limited to gambling purposes, but can be used for non-gambling entertainment.

In another embodiment, each player can make an additional wager at the same time as the high-low wagers. This would give a player the opportunity to win a bonus payout when certain wild cards or designated cards are dealt to corresponding player and dealer card positions.

The card playing method of the present invention is easy to learn and play, yet is exciting and offers multiple win opportunities with each deal. Also, although the original bets can be of relatively low stakes, there is always the potential of a big payout. As to advantages for the casino, the rules are simple for dealers and can be played at a fast pace to increase betting. As noted above, if the decks are reshuffled after each round, card counting is virtually impossible. If plural decks are used, then more than one round can be played before reshuffling, if desired, and card counting would still be difficult. When two decks are used with ten wild cards and the payouts are as noted in the examples above, a house advantage of greater than 1% can be attained.

Figure 2:
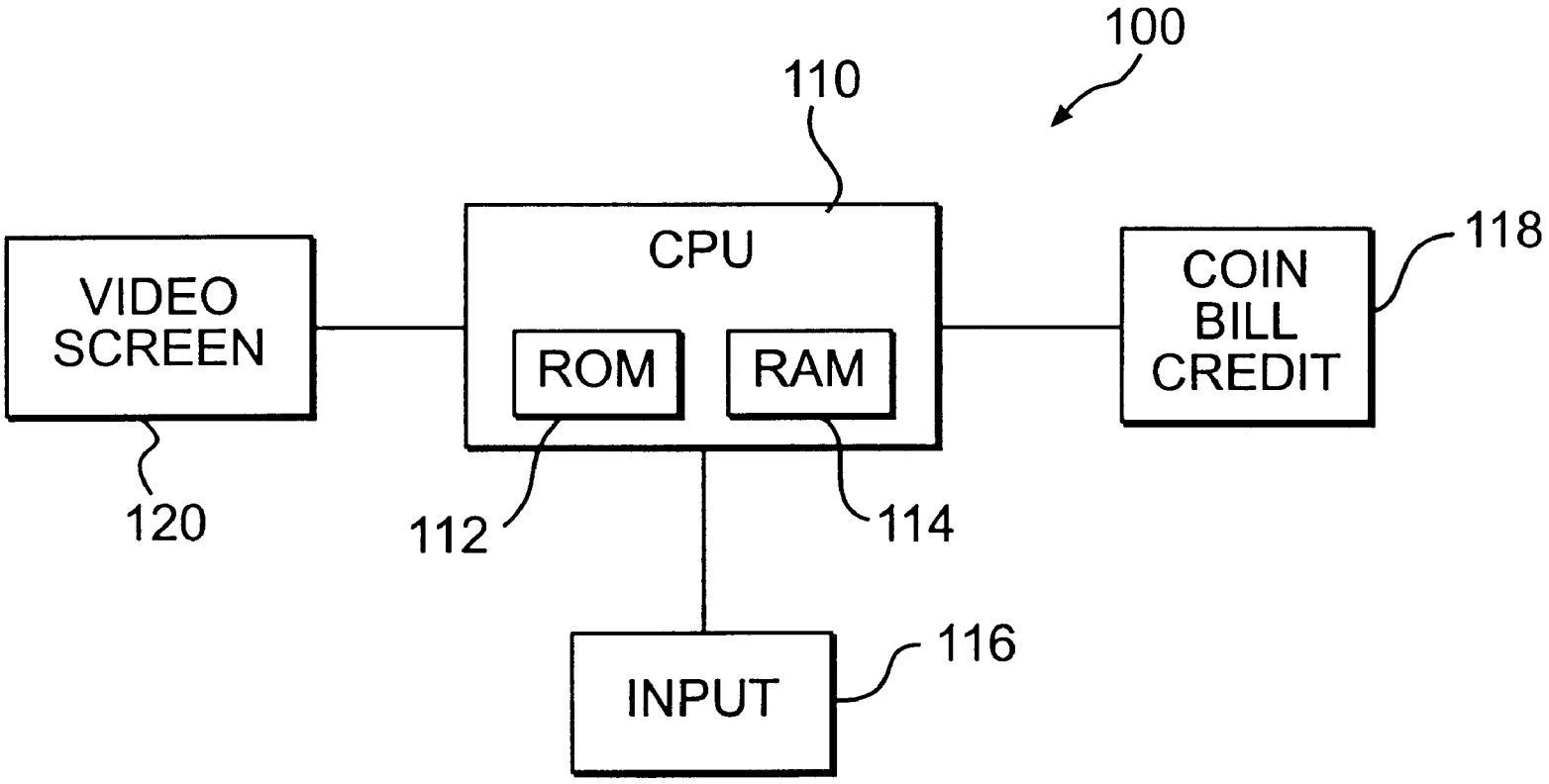
FIG. 2 is a schematic diagram of an electronic video game for use with the card playing method of the present invention.

The game playing method of the present invention is not to be limited to play with physical cards on a table. That is, the game can be embodied in an electronic video game 100 as shown in FIG. 2. In the video game embodiment, a central processing unit (CPU) 110 controls the various components. CPU 110 includes a ROM 112 for storing a control program and a RAM 114 for use as a work area. The video game includes an input unit 116 where one or more players can input their bets. A unit 118 can accept and pay out coins, bills and credit. Images of the game table and cards can be displayed on video screen 120. Play of the game is otherwise identical to that of the first described embodiment.

In another embodiment, the game playing method can be embodied, for example, in a scratch-off card game for use in lotteries and the like. In this embodiment, a player would purchase a scratch-off lottery card or ticket that would include, for example, one to three player card position scratch-off areas, a corresponding number of dealer card position scratch-off areas and a corresponding number of high/low betting scratch-off areas. In addition, each lottery card is preferably provided with a corresponding number of advanced high-low level card position scratch-off areas. The method of play is similar to that in the first embodiment. Initially, a player, having purchased a card for a set fee, scratches off either a high or a low betting area for each player card position. The player then scratches off the corresponding player card and dealer card position scratch-off areas. The player wins according to similar rules as those in the first embodiment, including those with regard to matched and unmatched wild cards. If a player card position reveals a wild card and the corresponding dealer card position does not include a wild card, then the player can scratch off the corresponding advanced high-low level card position and wins according to rules similar to the first embodiment. The player can turn in winning lottery cards to authorized establishments to receive appropriate winnings.

While the present invention has been described as to what is currently considered to be the preferred embodiments, it is to be understood that the invention is not limited to them. To the contrary, the invention is intended to cover various modifications and equivalent arrangements within the spirit and scope of the appended claims. For example, separate decks can be used for dealing to the dealer and dealing to the players. Also, the advanced level can be made optional for the players. The scope of the following claims is to be accorded the broadest interpretation so as to encompass all such modifications and equivalent structures and functions.

What is claimed is:

1. A method of playing a card game among a dealer and at least one player, said method comprising the steps of:

providing a playing board with at least one player card position and corresponding high/low betting area for each player and at least one dealer card position for the dealer;

providing at least one composite deck of cards including at least one "wild" card;

placing at least one high/low wager in a high/low betting area by each player;

dealing one card to each player card position having a high/low wager in its corresponding high/low betting area;

dealing at least one card to the dealer card position; and comparing a card in each player card position with a card in a corresponding dealer card position, wherein i) if a player card is of a rank higher than the rank of a corresponding dealer card, the player wins according to first predetermined odds if the player wagered high and loses if the player wagered low, ii) if a player card is of a lower rank than the rank of a corresponding dealer card, the player wins according to the first predetermined odds if the player wagered low and loses if the player wagered high, and iii) if a player card is a wild card, the player's wager is used in another level of comparison.

2. A method according to claim 1, wherein the at least one composite deck includes at least one standard playing card deck and plural wild cards.

3. A method according to claim 1, wherein the standard playing card deck is modified.

4. A method according to claim 1, wherein in said comparing step, if a player card is of rank equal to the rank of a corresponding dealer card, the player loses regardless of whether the player wagered high or low.

5. A method according to claim 1, wherein in said comparing step, if a player card is not a wild card and a corresponding dealer card is a wild card, the player loses regardless of whether the player wagered high or low.

6. A method according to claim 1, wherein in the other level of comparison, an additional card is dealt and i) if the additional card is a low card, the player wins according to second predetermined odds if the player originally wagered low and ii) if the additional card is a high card, the player wins according to the second predetermined odds if the player originally wagered high.

7. A method according to claim 6, wherein the at least one composite deck includes at least one standard playing card deck with the eights removed, and in the other level of comparison twos through sevens are low cards and nines through aces are high cards.

8. A method according to claim 6, wherein if the additional card is a wild card, the player wins according to third predetermined odds.

9. A method according to claim 8, wherein the at least one composite deck includes plural wild cards, at least two of which match, and the third predetermined odds includes lower and higher levels of odds, if the additional card is a wild card that does not match the player's wild card, the player wins according to the lower level of odds and if the additional card is a wild card that matches the player's wild card, the player wins according to the higher level of odds.

10. A method according to claim 1, wherein the at least one composite deck includes plural wild cards and in said comparing step if a player card is a wild card and a responding dealer card is a wild card, the player wins according to odds higher than the first predetermined odds.

11. A method according to claim 10, wherein at least two of the wild cards of the at least one composite deck match and i) if the player's wild card does not match the dealer's wild card, the player wins according to a first level of odds and ii) if the player's wild card matches the dealer's wild card, the player wins according to a second level of odds higher than the first level of odds.

12. A method according to claim 11, wherein each player is provided with at least two player card positions and the dealer is provided with at least two corresponding dealer card positions, i) if matched wild cards are dealt in one player card position and one corresponding dealer card position, the player wins according to the second level of odds and ii) if matched wild cards are dealt in at least two player card position areas and corresponding dealer card position areas, the player wins according to a level of odds higher than the second level of odds or wins a predetermined jackpot.

13. A method according to claim 1, wherein each player is provided with at least two player card positions and corresponding high/low betting areas and the dealer is provided with at least two corresponding dealer card positions.

14. A method according to claim 13, wherein each player is required to place a wager in at least one high/low betting area to play, each player is dealt one card for each wager and the dealer is dealt a number of cards equal to the highest number of cards dealt to any one player.

15. A method according to claim 1, wherein said method is executed at least in part by an electronic device.

16. A method according to claim 1, wherein said method is effected with a scratch-off card comprising the playing board, said step of placing a wager is effected by scratching off a high/low betting area and said dealing steps are effected upon printing the card.

17. A method of playing a card game among a dealer and at least one player, said method comprising the steps of:

providing a playing board with at least one player card position and corresponding high/low betting area for each player and at least one dealer card position for the dealer;

providing at least one composite deck of cards including at least two "wild" cards;

placing at least one high/low wager in a high/low betting area by each player;

dealing one card to each player card position having a high/low wager in its corresponding high/low betting area;

dealing at least one card to the dealer card position; and comparing a card in each player card position with a card in a corresponding dealer card position, wherein i) if a player card is of a rank higher than the rank of a corresponding dealer card, the player wins according to first predetermined odds if the player wagered high and loses if the player wagered low, ii) if a player card is of a lower rank than the rank of a corresponding dealer card, the player wins according to the first predetermined odds if the player wagered low and loses if the player wagered high, and iii) if a player card is a wild card and a corresponding dealer card is a wild card, the player wins according to at least second predetermined odds higher than the first predetermined odds.

18. A method according to claim 17, wherein the at least one composite deck includes at least one standard playing card deck and plural wild cards.

19. A method according to claim 18, wherein the standard playing card deck is modified.

20. A method according to claim 17, wherein in said comparing step, if a player card is of rank equal to the rank of a corresponding dealer card, the player loses regardless of whether the player wagered high or low.

21. A method according to claim 17, wherein in said comparing step, if a player card is not a wild card and a corresponding dealer card is a wild card, the player loses regardless of whether the player wagered high or low.

22. A method according to claim 17, wherein the at least one composite deck includes more than two wild cards, at least two of which match, and in said comparing step, i) if the player's wild card does not match the dealer's wild card, the player wins according to the second predetermined odds and ii) if the player's wild card matches the dealer's wild card, the player wins at least according to third predetermined odds higher than the second predetermined odds.

23. A method according to claim 22, wherein each player is provided with at least two player card positions and the dealer is provided with at least two corresponding dealer card positions, i) if matched wild cards are dealt in one player card position and one corresponding dealer card position, the player wins according to the third predetermined odds and ii) if matched wild cards are dealt in at least two player card positions and corresponding dealer card positions, the player wins according to a level of odds higher than the third predetermined odds or wins a predetermined jackpot.

24. A method according to claim 17, wherein in said comparing step, if a player card is wild and a corresponding dealer card is not wild, the original high/low wager is used in another level of comparison.

25. A method according to claim 24, wherein in the other level of comparison, an additional card is dealt and i) if the additional card is a low card, the player wins according to third predetermined odds if the player originally wagered low and ii) if the additional card is a high card, the player wins according to the third predetermined odds if the player originally wagered high.

26. A method according to claim 25, wherein the at least one composite deck includes at least one standard playing card deck with the eights removed, and in the other level of comparison twos through sevens are low cards and nines through aces are high cards.

27. A method according to claim 25, wherein if the additional card is a wild card, the player wins according to fourth predetermined odds.

28. A method according to claim 27, wherein the at least one composite deck includes more than two wild cards, at least two of which match, and the fourth predetermined odds includes lower and higher levels of odds, i) if the additional card is a wild card that does not match the player's wild card, the player wins according to the lower level of odds and ii) if the additional card is a wild card that matches the player's wild card, the player wins according to the higher level of odds.

29. A method according to claim 17, wherein each player is provided with at least two player card positions and corresponding high/low betting areas and the dealer is provided with at least two corresponding dealer card positions.

30. A method according to claim 29, wherein each player is required to place a wager in at least one high/low betting area to play, each player is dealt one card for each wager and the dealer is dealt a number of cards equal to the highest number of cards dealt to any one player.

31. A method according to claim 17, wherein said method is executed at least in part by an electronic device.

32. A method according to claim 17, wherein said method is effected with a scratch-off card comprising the playing board, said step of placing a wager is effected by scratching off a high/low betting area and said dealing steps are effected upon printing the card.

33. A method of playing a card game among a dealer and at least one player, said method comprising the steps of:

providing a playing board with at least one player card position and corresponding high/low betting area for each player and at least one dealer card position for the dealer;

providing at least one composite deck of cards including plural "wild" cards, at least two of which match;

placing at least one high/low wager in a high/low betting area by each player;

dealing one card to each player card position having a high/low wager in its corresponding high/low betting area;

dealing at least one card to the dealer card position; and comparing a card in each player card position with a card in a corresponding dealer card position, wherein i) if a player card is of a rank higher than the rank of a corresponding dealer card, the player wins according to first predetermined odds if the player wagered high and loses if the player wagered low, ii) if a player card is of a lower rank than the rank of a corresponding dealer card, the player wins according to the first predetermined odds if the player wagered low and loses if the player wagered high, iii) if a player card is of rank equal to the rank of a corresponding dealer card, the player loses regardless of whether the player wagered high or low, iv) if a player card is not a wild card and a corresponding dealer card is a wild card, the player loses regardless of whether the player wagered high or low, and v) if a player card is a wild card and a corresponding dealer card is not a wild card, the player's wager is used in another level of comparison, wherein in the other level of comparison, an additional card is dealt and a) if the additional card is a low card, the player wins according to second predetermined odds if the player originally wagered low, b) if the additional card is a high card, the player wins according to the second predetermined odds if the player originally wagered high, and c) if the additional card is a wild card, the player wins according to third predetermined odds, including lower and higher levels of odds, such that if the additional card is a wild card that does not match the player's wild card, the player wins according to the lower level of odds and if the additional card is a wild card that matches the player's wild card, the player wins according to the higher level of odds.

34. A method of playing a card game among a dealer and at least one player, said method comprising the steps of:

providing a playing board with at least two players card positions and corresponding high/low betting areas for each player and at least two dealer card positions for the dealer;

providing at least one composite deck of cards including "wild" cards;

placing at least one high/low wager in a high/low betting area by each player;

dealing one card to each player card position having a high/low wager in its corresponding high/low betting area;

dealing at least one card to the dealer card position; and comparing a card in each player card position with a card in a corresponding dealer card position, wherein i) if a player card is of a rank higher than the rank of a corresponding dealer card, the player wins according to first predetermined odds if the player wagered high and loses if the player wagered low, ii) if a player card is of a lower rank than the rank of a corresponding dealer card, the player wins according to the first predetermined odds if the player wagered low and loses if the player wagered high, iii) if a player card is of rank equal to the rank of a corresponding dealer card, the player loses regardless of whether the player wagered high or low, iv) if a player card is not a wild card and a corresponding dealer card is a wild card, the player loses regardless of whether the player wagered high or low, and v) if a player card is a wild card and a corresponding dealer card is a wild card, the player wins according to at least second predetermined odds higher than the first predetermined odds, wherein a) if the player's wild card does not match the dealer's wild card, the player wins according to the second predetermined odds, b) if the player's wild card matches the dealer's wild card, the player wins at least according to third predetermined odds higher than the second predetermined odds, c) if matched wild cards are dealt in one player card position and one corresponding dealer card position, the player wins according to the third predetermined odds and d) if matched wild cards are dealt in at least two player card positions of one player and corresponding dealer card positions, the player wins according to a level of odds higher than the third predetermined odds or wins a predetermined jackpot.

* * * * *